United States Patent [19]

Gardiner et al.

[11] Patent Number: 4,890,135

[45] Date of Patent: Dec. 26, 1989

[54] PHOTOCONDUCTIVE DRUM CLEANING APPARATUS

[75] Inventors: Kenneth W. Gardiner, Menlo Park; Tatsu Hori, Los Altos; Norman F. Mangal, Palo Alto, all of Calif.

[73] Assignee: Savin Corporation, Stamford, Conn.

[21] Appl. No.: 394,279

[22] Filed: Jul. 1, 1982

Related U.S. Application Data

[63] Continuation of Ser. No. 154,109, May 28, 1980, abandoned, which is a continuation of Ser. No. 928,564, Jul. 27, 1978, abandoned, which is a continuation of Ser. No. 740,384, Nov. 10, 1976, abandoned, which is a continuation-in-part of Ser. No. 547,383, Feb. 6, 1975, abandoned.

[51] Int. Cl.[4] ..... G03G 21/00

[52] U.S. Cl. ..... 355/299; 15/256.53

[58] Field of Search ..... 355/15; 15/1.5, 256.53; 118/652

[56] References Cited

U.S. PATENT DOCUMENTS

| | | | |
|---|---|---|---|
| 3,759,220 | 9/1973 | Saito et al. | 355/15 X |
| 4,032,229 | 6/1977 | Tani et al. | 355/15 |
| 4,080,059 | 3/1978 | Tani et al. | 355/15 |

*Primary Examiner*—R. L. Moses

*Attorney, Agent, or Firm*—Kenyon & Kenyon

[57] ABSTRACT

Apparatus for cleaning the photoconductive drum of an electrostatic copier in which a rotating foam roller and a self-cleaning squeegee blade are sequentially arranged adjacent the photoconductive surface at a location following the station at which the image has been transferred to copy material such as paper. The self-cleaning squeegee blade is formed by a driven endless belt which extends across the entire photoconductive surface and which is so disposed that an edge portion or portions contact the surface of the photoconductor. The endless belt is cleaned by means remote from the photoconductive surface. In various embodiments of the invention the endless belt contacts the photoconductive surface at an acute, a right, and an obtuse angle to a tangent to the photoconductive surface. Means is provided for supplying developer liquid to the developer applicator on start-up of the machine and to the cleaning apparatus upon initiation of a copying operation. To prevent scratching of the photoconductive surface by the cleaning apparatus, the cleaning apparatus is retracted from the photoconductive surface until such time after initiation of a copying operation that the surface portion initially at the developer applicator has advanced to a position adjacent to the cleaning apparatus.

27 Claims, 5 Drawing Sheets

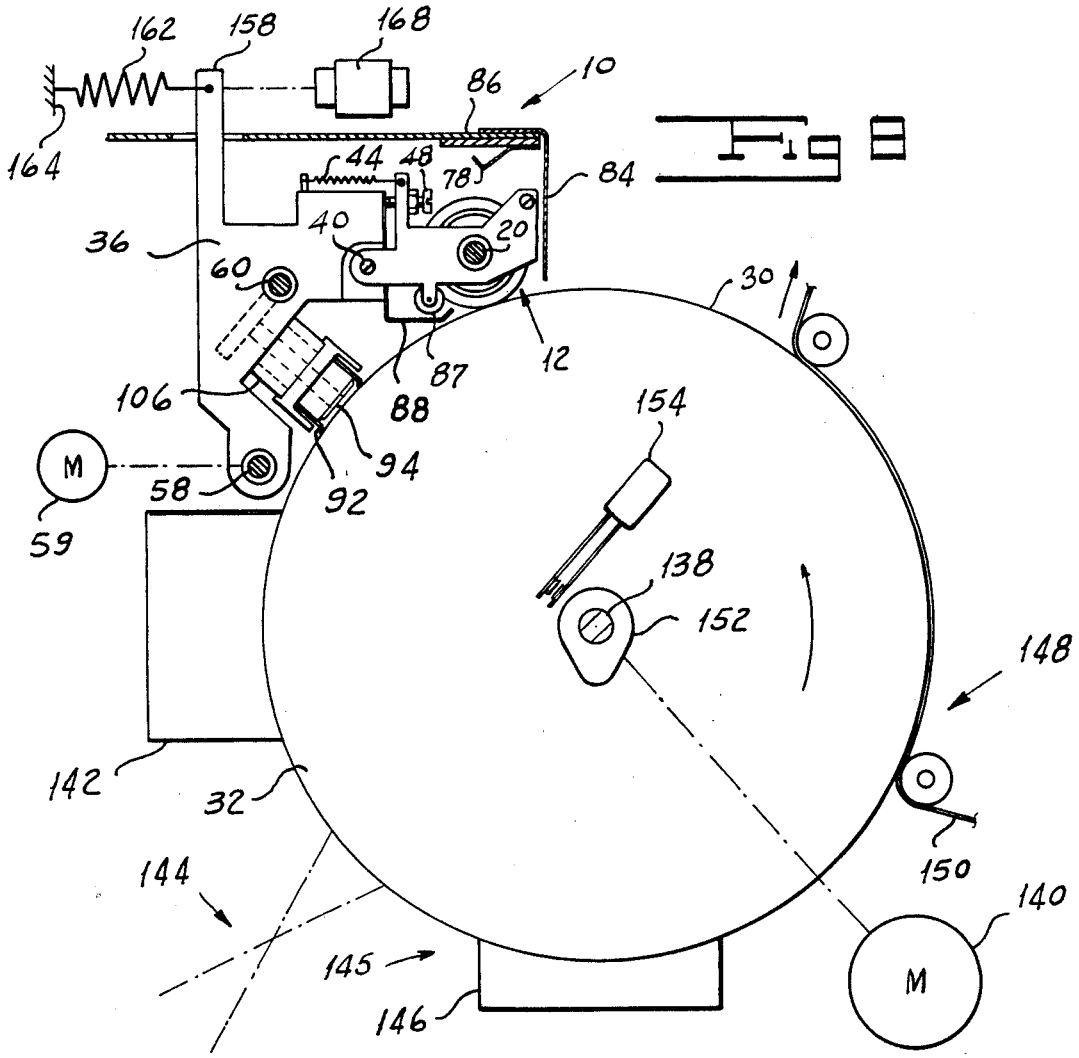
Fig 8
Fig 9
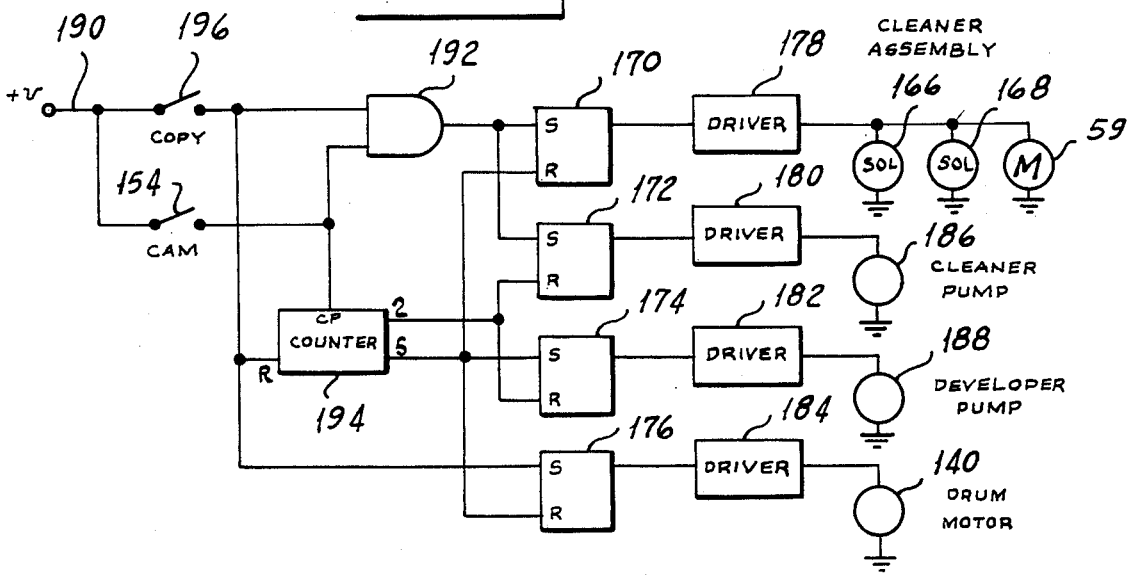

PHOTOCONDUCTIVE DRUM CLEANING APPARATUS

REFERENCE TO RELATED APPLICATION

This application is a continuation of application Ser. No. 154,109, filed May 28, 1980, now abandoned which is a continuation of application Ser. No. 928,564, filed July 27, 1978, now abandoned, which is a continuation of application Ser. No. 740,384, filed Nov. 10, 1976, now abandoned, which is a continuation-in-part of copending application Ser. No. 547,383, filed Feb. 6, 1975, now abandoned.

BACKGROUND OF THE INVENTION

This invention relates to an improved photoconductive drum cleaning apparatus for use with an electrostatic copier.

There exist, in the prior art, a number of systems designed to remove toner particles and other materials which accumulate on the photoconductive imaging surface and which, if allowed to remain on the imaging surface, would result in dirty copies and possible machine malfunction. Generally, these systems comprise belts, rollers, blades, and the like. While these systems have enjoyed some success, they have generated their own problems, one of which is buildup of toner fluid or other material on the cleaning surface themselves. This buildup impairs cleaning action of the system and may in time damage the photoconductive surface.

SUMMARY OF THE INVENTION

One object of our invention is to provide a photoconductive drum cleaning apparatus which effectively cleans the photoconductive surface.

Another object of our invention is to provide a photoconductive drum cleaning apparatus which does not scratch the photoconductive surface.

A third object of our invention is to provide a photoconductive drum cleaning apparatus which resists clogging.

A fourth object of our invention is to provide a photoconductive drum cleaning apparatus which is simple and compact.

Other and further objects of our invention will appear from the following description.

In general our invention contemplates photoconductive drum cleaning apparatus comprising a rotating foam roller and a self-cleaning squeegee blade sequentially arranged adjacent to and in contact with the photoconductive surface at a location beyond that at which image transfer takes place and ahead of the charging station. The self-cleaning squeegee blade is formed by a driven endless rubber of polyurethane belt supported by pulleys located outboard of the drum so that the belt extends completely across the photoconductive surface. The belt is so disposed as to contact the photoconductive surface at an angle to a tangent to the drum so that an edge portion of the belt engages the photoconductive surface. The endless belt is itself cleaned as it is driven past a cleaning station located away from the photoconductive surface. In various embodiments of the invention, the endless belt contacts the photoconductive surface at a right angle or at an acute angle to a tangent to the photoconductive surface.

Our cleaning apparatus substantially avoids the problem of cleaning system clogging and the attendant risk of damage to the photoconductive surface. The foam roller, which rotates in the same direction as the photoconductive surface and is supplied with liquid developer during the course of a copying operation, provides the basic cleaning action. The self-cleaning squeegee blade enhances the cleaning action and, in addition, wipes the photoconductive surface dry. Because the squeegee blade is itself being continually cleaned by its auxiliary cleaning system, there is little danger of toner buildup on the blade scratching the photoconductive surface. While the preferred embodiment of our invention is described in relation to a copying machine employing a drum, our cleaning apparatus is equally adaptable to a machine employing a photoconductive surface of the endless belt type.

In the machine for which our apparatus is designed, developer is supplied to the developer applicator when the machine is turned on and to the cleaning apparatus upon initiation of a copying operation.

Our invention further comprises means for maintaining the cleaning apparatus out of engagement with the photoconductive surface while the surface is stationary and moving the apparatus into engagement with the surface after the surface portion initially at the developing station has advanced to a position adjacent to the cleaning apparatus. In this manner, we ensure that the cleaning apparatus contacts the photoconductive surface only after the surface has been wetted by liquid developer in the developing station and thus avoid the possibility of scratching the surface by contacting it while it is dry.

BRIEF DESCRIPTION OF THE DRAWINGS

In the accompanying drawings which form part of the instant specification and which are to be read in conjunction therewith and in which like reference numerals are used to indicate like parts in the various views:

FIG. 3 is a top plan of the roller subassembly of our cleaning apparatus, with parts broken away.

FIG. 8 is a side elevation, shown partly in section, of a copying machine employing our cleaning apparatus.

FIG. 9 is a schematic of the control circuit associated with the machine shown in FIG. 1.

DESCRIPTION OF THE PREFERRED EMBODIMENTS

Figure 1:
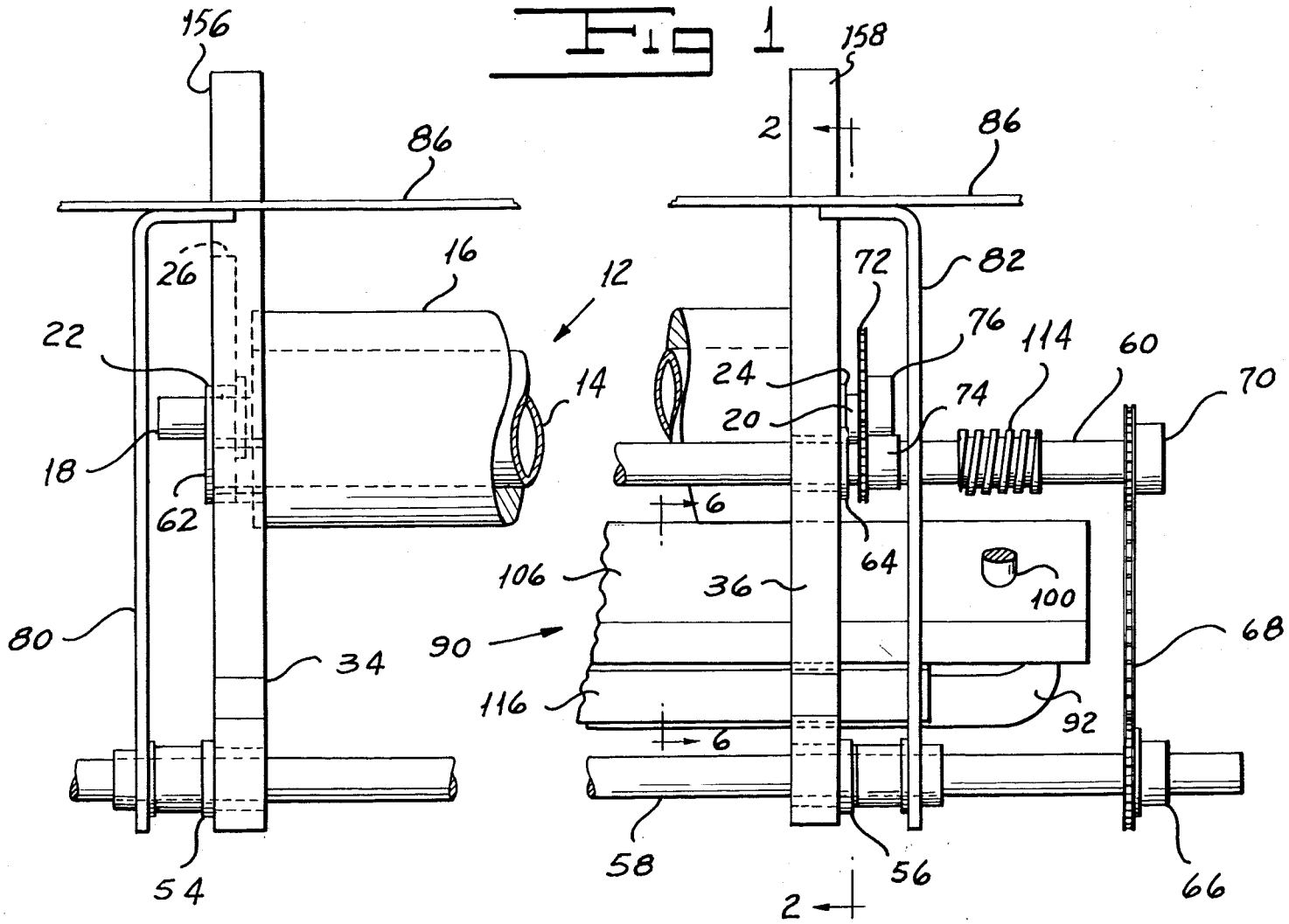
FIG. 1 is a rear elevation of our cleaning apparatus, with parts broken away.
Figure 6:
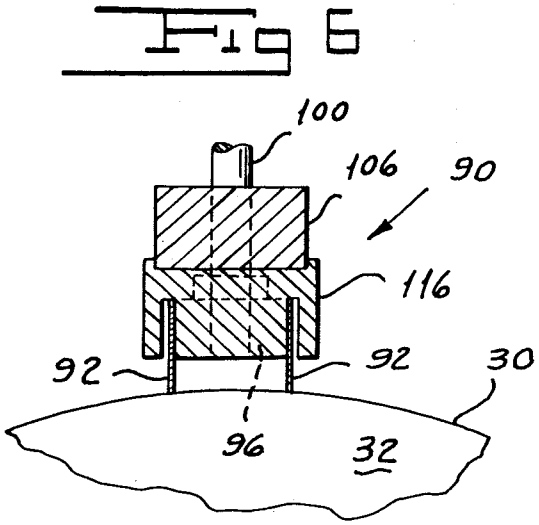
FIG. 6 is a section of the blade assembly of our cleaning apparatus taken along line 6—6 of FIG. 1.

Referring to FIGS. 1 to 6 and 8, our cleaning apparatus, indicated generally by the reference numeral 10, is intended to be used with a cylindrical drum 32 having a photoconductive outer surface 30. The drum 32 is supported by a shaft 138 which is driven by a motor 140 in a counterclockwise direction, as seen in FIG. 8, past a plurality of processing stations, as is known in the prior art. These stations include a corona charging station 142 at which the photoconductive surface 30 is uniformly electrostatically charged, an exposure station 144 at which the surface is exposed to a light image of an original to form an electrostatic latent image, a developing station 145 at which a liquid developer is applied from a developing tank 146 to form a visible image, and an image transfer station 148 at which the developed image is transferred to a sheet of paper 150. Shaft 138 carries for rotation therewith a cam 152 which momentarily closes the contacts of a switch 154 as the cam moves through a predetermined angular position, for a purpose to be more fully described.

The cleaning apparatus 10 includes a cylindrical roller indicated generally by the reference character 12 having an aluminum core 14 and a covering layer 16 of polyurethane foam or the like. The roller 12 is mounted on stub shafts 18 and 20 which are supported by bearings 22 and 24 located respectively in roller support brackets 26 and 28. When in use, the roller 12 contacts the photoconductive surface 30 of the drum 32 at a location between the transfer station 148 and the charging station 142.

Pivot screws 38 and 40 mount the roller support brackets 26 and 28 on cleaner support brackets 34 and 36 for movement of roller 12 toward and away from the surface 30 of drum 32. Tension springs 42 and 44 extending between brackets 34 and 36 and brackets 26 and 28 urge roller 12 to move away from drum 32 to a limit position defined by adjusting screws 46 and 48. Screws 46 and 48 can be turned to adjust the position of roller 12 and thus the pressure exerted by the roller on the surface 30 of drum 32. A pair of rods 50 and 52, extending respectively between the roller support brackets 26 and 28 and cleaner support brackets 34 and 36, give the roller subassembly torsional rigidity.

Figure 2:
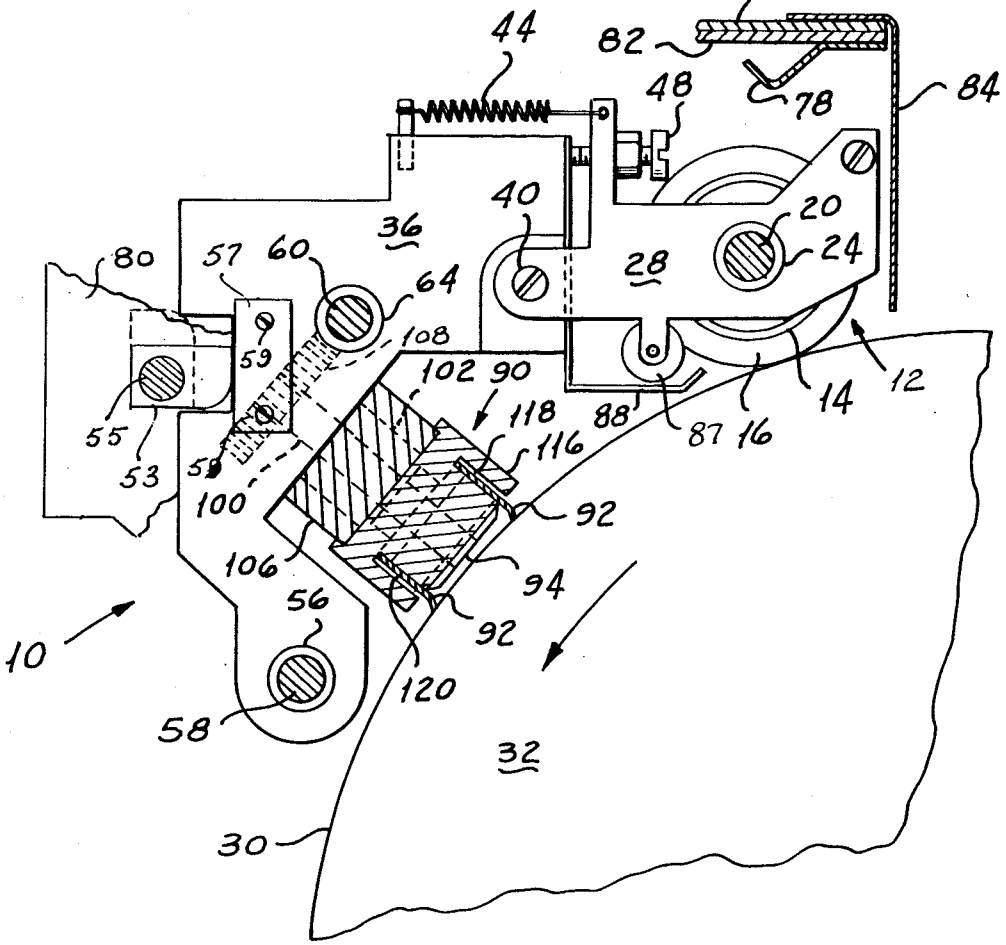
FIG. 2 is a section of our cleaning apparatus taken along line 2—2 of FIG. 1.
Figure 5:
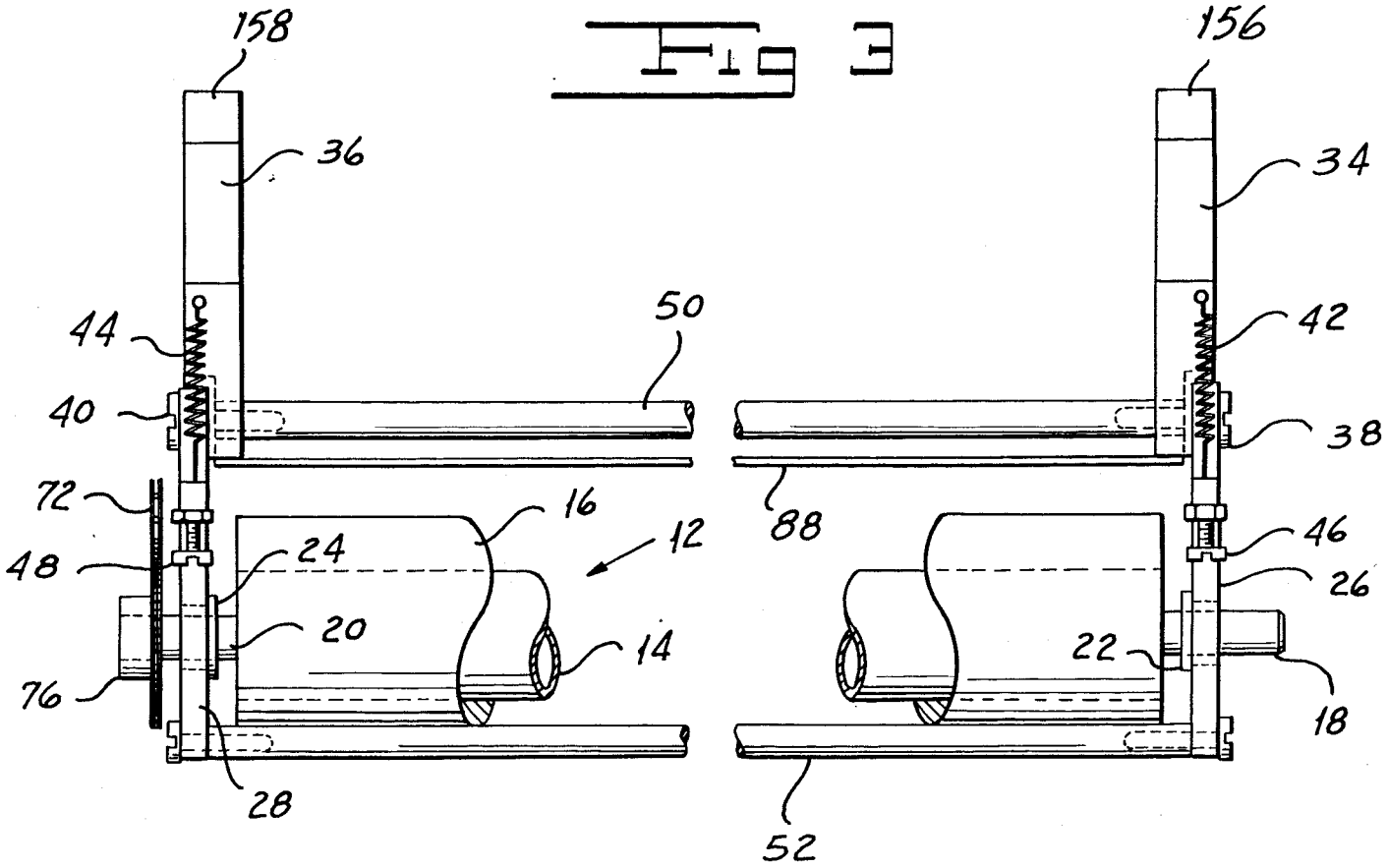
FIG. 5 is a bottom plan of the blade assembly shown in FIG. 4.
Figure 4:
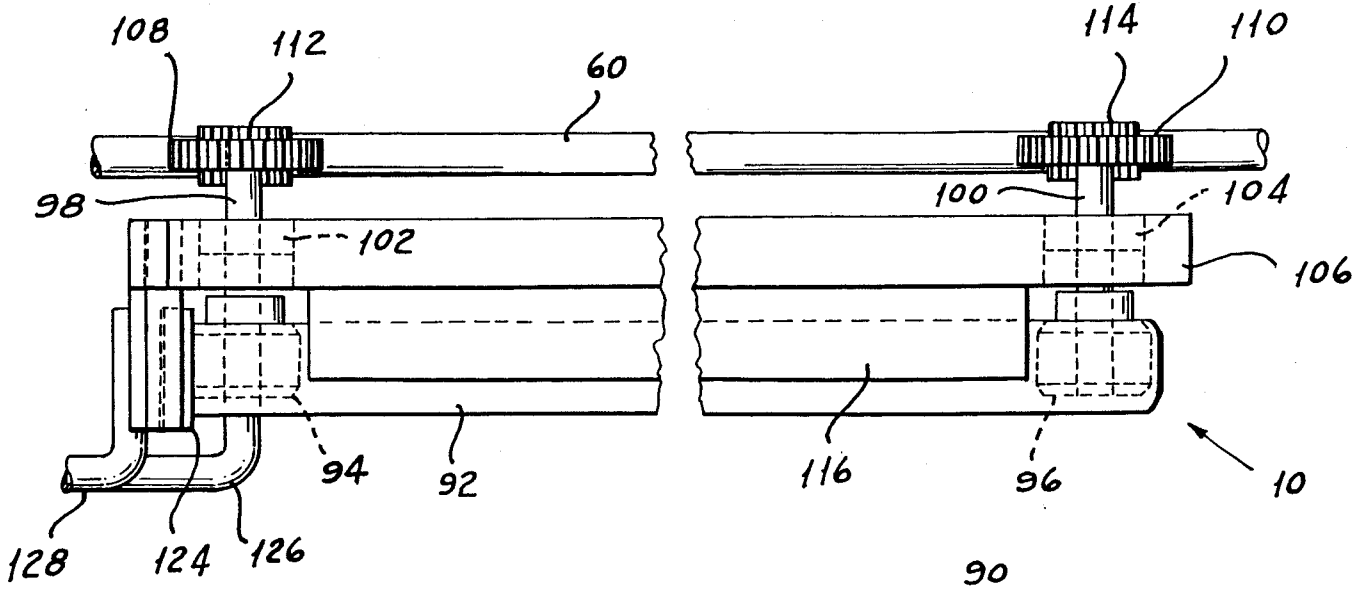
FIG. 4 is a side elevation of the blade assembly of our cleaning apparatus.
Figure 5:
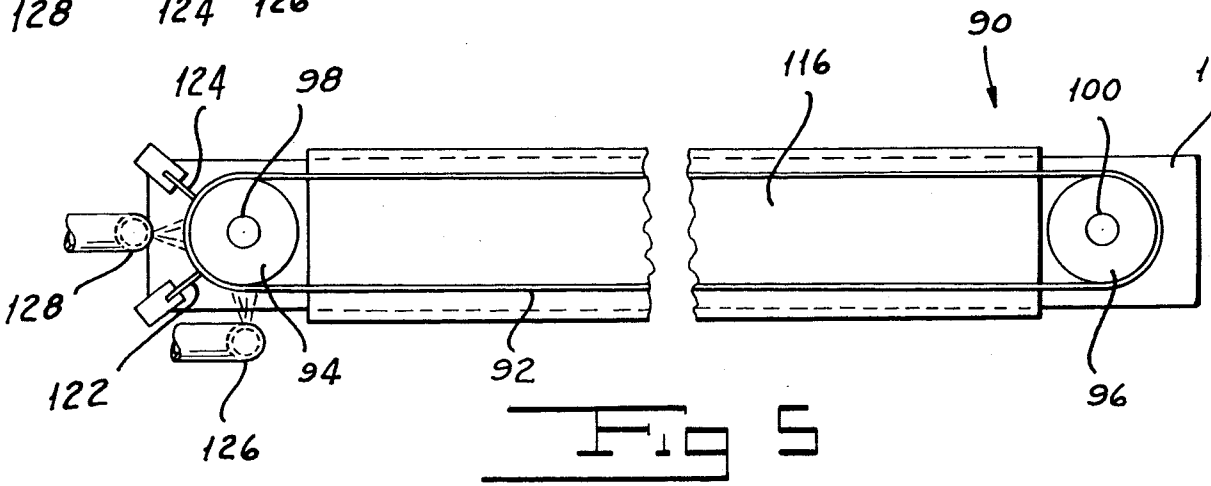

Bearings 54 and 56 pivotally mount cleaner support brackets 34 and 36 on a main drive shaft 58 driven by a motor 59. The entire cleaning apparatus 10 is thus mounted on the shaft 58 for movement toward and away from drum 32. We form support brackets 34 and 36 with upwardly extending arms 156 and 158. The cleaning apparatus 10 is normally biased away from the drum surface 30 against a pair of stops 161 (FIG. 2) by means of tension springs 162 extending between the respective arms 156 and 158 and a fixed frame portion 164. Actuation of a pair of solenoids 166 and 168 coupled to the respective arms 156 and 158 causes the apparatus 10 to move into engagement with the surface 30, the limit position being determined by a second pair of stops 169 (FIG. 2).

Bearings 62 and 64 on cleaner support brackets 34 and 36 rotatably support an intermediate drive shaft 60. A sprocket wheel 66 mounted on the main drive shaft 58 drives a chain 68 which drives a second sprocket wheel 70 carried by the intermediate drive shaft 60. The intermediate drive shaft 60 and the roller stub shaft 20 are coupled by means of a chain 72 which engages the teeth of sprocket wheels 74 and 76 located on the respective shafts. Rotation of the main drive shaft 58 will thus drive both the intermediate drive shaft 60 and the roller 12 with the roller 12 moving in a direction opposite to that of the drum surface 30 at the point of tangency.

As is explained more fully below, preferably we supply developer liquid to the cleaning roller 12 by means of a trough 78 which is disposed above the roller 12 and is supported between respective end support brackets 80 and 82. This is not done until after a copying operation has been initiated. A leading edge splash cover 84 mounted on an upper frame 86 extends across the width of the cleaning roller 12 at a location just beyond the roller 12 in the direction of rotation of drum 32. Preferably, we provide our apparatus with a steel roller 87 rotatably supported on brackets 26 and 28 at a location at which it squeezes the foam layer 16 to remove excess liquid therefrom. This arrangement permits us to supply a sufficient quantity of developer from trough 78 to flush roller 12 fully while at the same time preventing an excessive amount of liquid from being thrown from roller 12. Roller 87 may be freely rotatable or it may be driven to reduce drag on roller 12. We position a tray 88 below roller 87 to collect liquid being squeezed out of roller 12. Tray 88 directs the collected liquid to one side of the machine at which it is fed back to the developer supply system.

The wiper blade assembly of the cleaning system, indicated generally by the reference character 90, includes an endless belt 92 which is composed of nitrile rubber, polyurethane, or other developer carrier liquid resistant flexible material. We stretch the belt 92 between two pulleys 94 and 96 located outboard of the drum ends. In the preferred embodiment of our invention, both traverses of the belt 92 contact the photoconductive surface 30 generally perpendicularly across its width, as shown, providing additional cleaning action. We mount the pulleys 94 and 96 on shafts 98 and 100 supported by respective bearings 102 and 104 disposed in a support member 106. The support member 106 is fixedly secured to cleaner support brackets 34 and 36 by any suitable means such as welding or the like. Pulley shafts 98 and 100 are coupled to the intermediate drive shaft 60 through respective sets of worm gears, one of which is made up of a worm wheel 108 and a worm 112 and the other of which is made up of a worm wheel 110 and a worm 114. The belt 92 is kept in substantially perpendicular engagement with the photoconductive surface 30 by means of a guide 116 mounted beneath the support member 106 between the pulleys 94 and 96. The guide 116, formed of a suitable low friction material such as polytetrafluoroethylene copolymer, has a generally rectangular cross section, and is provided with grooves 118 and 120 for receiving the upper portion of the linear segments of the belt 92.

A pair of wiper blades 122 and 124 are urged into contact with the endless belt 92 at the left end of its circuit. These wiper blades remove the toner and other material picked up by the endless belt 92, and are assisted in their cleaning action by feed pipes 126 and 128, which spray the surface of the belt 92 with jets of developer liquid through exit orifices 130 and 132.

Actuation of the various electromechanical devices used in our cleaning system is controlled by the circuit shown in FIG. 9. The circuit includes four flip-flops 170, 172, 174, and 176, which are turned on by applying signals to the S or "set" inputs and are turned off by applying signals to the R or "reset" inputs. Flip-flops 170, 172, 174 and 176 are coupled to suitable driver circuits 178, 180, 182, and 184, which are in turn coupled to the electromechanical devices. More particularly, circuit 178 drives the cleaner solenoids 166 and 168 and the cleaner motor 59. Circuit 180 drives a cleaner pump 186, which controls the flow of liquid developer to the developer trough 78 and the feed pipes 126 and 128. Circuit 182 drives a developer pump 188, which controls the flow of liquid developer to the developing tank at the developing station 145. Circuit 184 drives the drum motor 140.

Cam switch 154 has one of its terminals connected to a line 190 coupled to a suitable voltage source. The other terminal of switch 154 is connected to one input of a two-input AND gate 192 and to the clock-pulse (CP) or counting input of a counter 194. Line 190 is also coupled to one terminal of a copy switch 196 which remains closed during a copying cycle. The other terminal of switch 196 is coupled to the second input of AND gate 192, the R or reset input of counter 194, and the S input of flip-flop 176. AND gate 192 has its output coupled to the S inputs of flip-flops 170 and 172. Counter 194 provides a first signal, indicating a count of two, to the R inputs of flip-flops 172 and 174 and provides a second signal, indicating a count of five, to the R inputs of flip-flops 170 and 176 and the S input of flip-flop 174.

Before a copy cycle is started, the drum 32 is at rest with the cam 152 oriented as shown in FIG. 8. Switches 154 and 196 are open; flip-flops 170, 172, and 176 are off; and flip-flop 174 is on so as to energize the developer pump 188. Closure of the copy switch 196 at the beginning of a copy cycle causes voltage to be applied from line 190 to the S terminal of flip-flop 176, turning on that flip-flop to start the drum motor 140. As the surface of the drum rotates counterclockwise through the developing station 145, it becomes coated with liquid developer. When the wetted portion of the drum surface reaches the cleaning apparatus 10, cam 152 has rotated to a position at which it closes the switch 154. AND gate 192 then provides a signal to the S input of flip-flop 170 to turn on that flip-flop and actuate the cleaner motor 59 and the cleaner solenoids 166 and 168, which move the cleaning apparatus 10 into engagement with the wetted drum surface 30. AND gate 192 also turns on flip-flop 172, which actuates the cleaner pump 186 to cause developer liquid to be supplied to the toner trough 78.

As the drum 32 rotates in a counterclockwise direction to carry the surface from the image transfer station into the cleaning station, the foam-covered roller 12, the surface of which is moving in a direction opposite to that of the drum surface along the line of contact, scrubs the surface to loosen adhering toner particles and the like. Developer flowing onto the roller 12 prevents agglomeration of toner particles on the roller. After the surface 30 leaves the roller 12, it is engaged by an edge portion of belt 92, which acts to complete the cleaning process by removing any remaining toner particles from the surface 30 while at the same time wiping the surface dry. Any material carried away from the surface 30 are removed from the belt through the action of wiper 122 and 124 and developer jets from pipes 126 and 128.

At the end of the copy cycle, switch 196 reopens to remove the potential from the R input of counter 194, allowing the counter to be clocked by successive closings of the cam switch 154. While the counter 194 is being clocked, operation of the cleaning system is continued to clean the drum surface completely and to allow the belt and sponge roller to be thoroughly flushed with developer. After two rotations of the drum or about six seconds, assuming a rotation period of three seconds, counter 194 provides a signal on the 2 line to reset flip-flops 172 and 174, turning off the cleaner pump 186 and the developer pump 188. Cutting off the supply of developer and cleaner liquid in this manner permits the roller 12 to squeeze out excess liquid and the belt 92 to clear the excess developer liquid from in front of the squeegee point. After another three drum rotations or about nine seconds, counter 194 provides a signal on the 5 line to reset flip-flops 170 and 176 and set flip-flop 174. As a result, cleaner solenoids 166 and 168 are deactuated, permitting the cleaning apparatus to move away from the drum, and the cleaner and drum motors are also deactuated so that the drum comes to rest in the original position shown in FIG. 1. At the same time, developer pump 188 is reactuated to ensure a supply of developer liquid when the next copy cycle is begun. It is to be understood that the particular logic circuitry we have shown is by way of example only. Any suitable arrangement may be used which ensure that the cleaning system is not brought into contact with the drum until a wetted portion of the drum surface arrives at the cleaning station.

Figure 7:
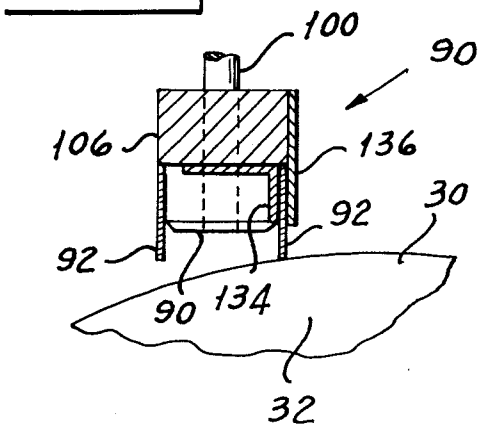
FIG. 7 is a section of an alternative embodiment of the blade assembly which contacts the photoconductive surface along one transverse only.

Referring now to FIG. 7, we show an alternative embodiment of our blade assembly designed to contact the photoconductive surface along only one edge of the endless belt. This embodiment is substantially identical to the first embodiment except that guide means, comprising an inner guide wall 130 having an L-shaped cross-section and an outer guide wall 136, encloses only one traverse of the belt 92. The blade assembly 90 is also inclined with respect to the photoconductive surface 30 to provide a suitable contacting angle. The contacting edge of the belt 92 may be inclined either into or against the direction of the rotation of the drum 32.

It will be seen from the foregoing description that we have accomplished the objects of our invention. Our cleaning apparatus effectively cleans the photoconductive surface. It does not scratch the photoconductive surface. Our cleaning apparatus minimizes clogging.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. Apparatus for cleaning a moving imaging surface including in combination, an elongated squeegee blade having a pair of spaced parallel edge portions, means for supporting said blade across said imaging surface with said edge portions engaging said surface along spaced parallel lines of contact, and means for effecting opposite lengthwise movement of said edge portions along said lines of contact.

2. Apparatus as in claim 1 in which the elongated squeegee blade comprises an endless belt.

3. Apparatus as in claim 2 in which said blade supporting means comprises two pulleys located respectively on opposite sides of said imaging surface, said blade being supported by said pulleys.

4. Apparatus as in claim 1 including auxiliary means located away from the imaging surface for cleaning the elongated squeegee blade.

5. Apparatus as in claim 4 in which the auxiliary cleaning means comprises means for directing a jet of cleaning fluid onto the squeegee blade.

6. Apparatus as in claim 4 in which the auxiliary cleaning means comprises a wiper blade.

7. Apparatus as in claim 1 in which the squeegee blade comprises nitrile rubber.

8. Apparatus as in claim 1 in which the squeegee blade comprises polyurethane.

9. Apparatus as in claim 1 including a cylindrical roller having a porous outer layer and arranged to contact the imaging surface across its width at a point which is ahead of the squeegee blade, means for applying cleaning fluid to the roller, and means for rotating the roller.

10. Apparatus as in claim 9 in which said cylindrical roller is covered with a layer of polyurethane foam.

11. Apparatus as in claim 9 in which said roller is rotated in a direction opposite to the imaging surface at their point of tangency.

12. Apparatus as in claim 9 including a hard roller mounted for rotary movement in engagement with said porous outer layer to squeeze excess cleaning fluid therefrom.

13. Apparatus as in claim 1 including means disposed along said lines of contact for providing channels for receiving the blade portions remote from the imaging surface.

14. Apparatus for removing residual toner particles from an imaging surface adapted to be moved along a path past a cleaning station including in combination a roller having a spongy outer surface, means for rotatably mounting said roller at said station in contact with said imaging surface at a location at which said surface enters said station, means for driving said roller in a direction of surface movement thereof opposite to that of the imaging surface at the region of contact between the roller and the imaging surface to provide a scrubbing action to remove a major portion of toner particles from said imaging surface, an elongated squeegee blade, said squeegee blade comprising an endless belt having two spaced parallel linear segments, means for mounting said squeegee blade at said station at a location beyond said roller with the length thereof extending across and with the edges of both linear segments thereof in contact with said imaging surface, and means for driving said blade in a direction of its length to wipe said surface dry and to remove and carry away any toner particles remaining thereon following the action of the cleaning roller.

15. Apparatus for removing residual toner particles from an imaging surface adapted to be moved along a path past a cleaning station including in combination a roller having a spongy outer surface, means for rotatably mounting said roller at said station in contact with said imaging surface at a location at which said surface enters said station, means for driving said roller in a direction of surface movement thereof opposite to that of the imaging surface at the region of contact between the roller and imaging surface to provide a scrubbing action to remove a major portion of toner particles from said imaging surface, an elongated squeegee blade, said squeegee blade comprising an endless belt having two spaced parallel linear segments, means for mounting said squeegee blade at said station at a location beyond said roller with the length thereof extending across and with an edge thereof in contact with said imaging surface, said means for mounting said squeegee blade comprising a pair of pulleys located respectively on opposite sides of said imaging surface, said pulleys being oriented such that the edge of said squeegee blade engages the imaging surface along one of said linear segments and is spaced from said surface along the other of said linear segments, and means for driving said blade in the direction of its length to wipe said surface dry and to remove and carry away any toner particles which remain thereon following the action of the cleaning roller.

16. A photocopy apparatus having:

a rotatable drum bearing thereon a photosensitive surface;

means for creating on said surface an electrostatic latent image;

means for contacting said photosensitive surface with a liquid developer at a developing station for developing said latent image;

means for transferring the developed latent image to a copy medium;

means for cleaning residual developer from said photosensitive surface after transfer of said developed image to the copy medium;

said cleaning means having at least a cleaning blade and a cleaning roller, means for moving said blade and said roller between an inoperative position spaced away from said photosensitive surface and an operative position in contact with said photosensitive surface;

means for rotating said rotatable drum, said contacting means and said moving means cooperatively adapted to move said blade and said roller from the inoperative position to the operative position a predetermined time after the initiation of drum rotation whereby said blade and said roller when they are in their operative position contact a said photosensitive surface which has been wetted with said liquid developer at said developing station; and means for supplying said liquid developer directly to said cleaning means only when said blade and said roller are in their operative position in contact with said photosensitive surface.

17. The apparatus of claim 16 further comprising:

a pump for pumping developer solution to said cleaning means; and means for initiating operation of said pump prior to moving said blade and said roller to their operative position in contact with said drum.

18. The apparatus of claim 16 wherein said means for supplying said liquid developer to said cleaning means only when said blade and said roller are in their operative position comprises:

conduit means; and a pump for pumping said developer to said cleaning means through said conduit means;

said conduit means including an accumulator whereby the filling of said accumulator delays the delivery of said developer to said cleaning means until said blade and said roller are in their operative position.

19. A photocopying apparatus having:

a rotatable drum bearing thereon a photosensitive surface;

means for creating on said surface an electrostatic latent image;

means for contacting said photosensitive surface with a liquid developer at a developing station for developing said latent image;

means for transferring the developed latent image to a copy medium;

means for cleaning residual developer from said photosensitive surface after transfer of said developed image to the copy medium;

said cleaning means having at least a cleaning blade and a cleaning roller;

means for moving said blade and said roller between an inoperative position spaced away from said photosensitive surface and an operative position in contact with said photosensitive surface;

means for rotating said rotatable drum;

said contacting means and said moving means cooperatively adapted to move said blade and said roller from the inoperative position to the operative position a predetermined time after the initiation of drum rotation whereby said blade and said roller when they are in their operative position contact a said photosensitive surface which has been wetted with said liquid developer at said developing station; and means for supplying said liquid developer to said cleaning means only when said blade and said roller are in their operative position in contact with said photosensitive surface comprising:

conduit means; and means for pumping said developer to contact said surface at said developing station and to said cleaning means through said conduit means;

said conduit means including a section of increased volume whereby the filling of said section of increased volume delays the delivery of said developer to said cleaning means until said blade and said roller are in their operative position.

20. In an electrophotographic copier having a photoconductor adapted to bear an electrostatic latent image, said photoconductor being adapted to move successively through a developing station, a transfer station, and a cleaning station before returning to said developing station, means at said developing station for applying liquid developer to said photoconductor to form a developed image thereon, means at said transfer station for transferring said developed image to a carrier sheet, and a cleaning member at said cleaning station, the improvement comprising means for initially spacing said cleaning member from said photoconductor and means operable only upon the arrival at said cleaning station of a portion of said photoconductor wetted at said developing station for moving said cleaning member against said photoconductor to effect cleaning engagement therewith.

21. Apparatus as in claim 20 in which said moving means is operable concomitantly with the arrival of said wetted portion at said cleaning station.

22. Apparatus as in claim 20 including means operable only upon the movement of said cleaning member against said surface for supplying cleaning liquid directly to said cleaning member.

23. In an electrophotographic copier having a photoconductor adapted to bear an electrostatic latent image, said photoconductor being adapted to move successively through a developing station, a transfer station, and a cleaning station before returning to said developing station, said cleaning station being spaced a predetermined distance from said developing station, means at said developing station for applying liquid developer to said photoconductor to form a developed image thereon, means at said transfer station for transferring said developed image to a carrier sheet, and a cleaning member at said cleaning station, the improvement comprising means for initially spacing said cleaning member from said photoconductor and means operable only upon the movement of said photoconductor through said predetermined distance for moving said cleaning member against said photoconductor to effect cleaning engagement therewith.

24. Apparatus as in claim 23 in which said moving means is operable concomitantly with the movement of said photoconductor through said predetermined distance.

25. Apparatus as in claim 23 including means operable only upon the movement of said cleaning member against said surface for supply cleaning liquid directly to said cleaning member.

26. In an electrophotographic copier having a photoconductor adapted to bear an electrostatic latent image, said photoconductor being adapted to move successively through a developing station, a transfer station, and a cleaning station before returning to said developing station, means at said developing station for applying liquid developer to said photoconductor to form a developed image thereon, means at said transfer station for transferring said developed image to a carrier sheet, and a cleaning member at said cleaning station, the improvement comprising means for initially spacing said cleaning member for said photoconductor, means adapted to be actuated to move said cleaning member against said photoconductor, and means operable only upon the arrival at said cleaning station of a portion of said photoconductor wetted at said developing station for actuating said moving means to effect cleaning engagement of said cleaning member with said photoconductor.

27. In an electrophotographic copier having a photoconductor adapted to bear an electrostatic latent image, said photoconductor being adapted to move successively through a developing station, a transfer station, and a cleaning station before returning to said developing station, said cleaning station being spaced a predetermined distance from said developing station, means at said developing station for applying liquid developer to said photoconductor to form a developed image thereon, means at said transfer station for transferring said developed image to a carrier sheet, and a cleaning member at said cleaning station, the improvement comprising means for initially spacing said cleaning member from said photoconductor, means adapted to be actuated to move said cleaning member against said photoconductor, and means operable only upon the movement of said photoconductor through said predetermined distance for actuating said moving means to effect cleaning engagement of said cleaning member with said photoconductor.

* * * * *